US005947507A

United States Patent [19]

Quintana et al.

[11] Patent Number: 5,947,507

[45] Date of Patent: Sep. 7, 1999

[54] CROSS-COUNTRY SKI BINDING

[75] Inventors: Jason Quintana, Vancouver, Wash.; David Narajowski; Jordan Margid, both of Salt Lake City, Utah; Steven McDonald, Portland, Oreg.

[73] Assignee: Black Diamond Equipment, Ltd., Salt Lake City, Utah

[21] Appl. No.: 08/592,121

[22] Filed: Jan. 26, 1996

[51] Int. Cl.[6] ..... A63C 9/06

[52] U.S. Cl. ..... 280/615; 280/618; 280/619

[58] Field of Search ..... 280/614, 615–0, 280/619, 620, 621, 622, 633, 636, 618

[56] References Cited

U.S. PATENT DOCUMENTS

| | | | |
|---|---|---|---|
| 1,553,475 | 9/1925 | Schiess . | |
| 2,183,171 | 3/1939 | Refsdal . | |
| 2,199,444 | 5/1940 | Rauglas . | |
| 2,253,889 | 8/1941 | Carroll . | |
| 2,276,252 | 3/1942 | Nashe et al. . | |
| 2,314,270 | 3/1943 | Elliott . | |
| 2,600,688 | 6/1952 | Reuge | 280/614 |
| 2,661,957 | 12/1953 | Attenhofer . | |
| 2,673,743 | 3/1954 | Gould | 280/622 |
| 3,822,070 | 7/1974 | Salomon . | |
| 3,863,942 | 2/1975 | Burger . | |
| 3,877,712 | 4/1975 | Weckeiser | 280/614 |
| 4,029,336 | 6/1977 | Haimerl . | |
| 4,322,090 | 3/1982 | Loughney . | |
| 4,887,833 | 12/1989 | Bailey . | |
| 5,499,838 | 3/1996 | Hauglin et al. | 280/615 |
| 5,669,622 | 9/1997 | Miller . | |

FOREIGN PATENT DOCUMENTS

| | | | |
|---|---|---|---|
| 671329 | 12/1929 | France . | |
| 756374 | 12/1933 | France . | |
| 773572 | 9/1934 | France | 280/619 |
| 813853 | 6/1937 | France . | |
| 947025 | 6/1949 | France . | |
| 29879 | 2/1919 | Norway | 280/619 |
| 29879 | 7/1919 | Norway . | |
| 1200-920 | 6/1982 | Russian Federation . | |
| 185444 | 7/1936 | Switzerland . | |
| 185446 | 7/1936 | Switzerland . | |
| 201194 | 11/1938 | Switzerland . | |
| 409731 | 3/1966 | Switzerland . | |
| 429533 | 7/1967 | Switzerland . | |
| 284799 | 2/1928 | United Kingdom . | |

OTHER PUBLICATIONS

"Rottefella ® Products 1994" (Rottefella 1994 product catalog, in whole).

*Primary Examiner*—Richard M. Camby
*Assistant Examiner*—David R. Dunn
*Attorney, Agent, or Firm*—Thorpe, North & Western, L.L.P.

[57] ABSTRACT

A cross-country ski binding for mounting on a ski to hold a ski boot includes a base plate for mounting on the upper surface of the ski. The base plate has a front section on which a resilient compression element, such as a spring, is mounted. The compression element is coupled to a forward end of a cable so that when rearward force is applied to the cable, the compression element provides resistance to the rearward movement of the cable, and then expands to pull the cable forward when the rearward force is removed. A toe plate is mounted on the base plate for receiving and holding a ski boot toe. The toe plate has a channel formed below the upper surface thereof, which extends from the front section rearwardly for receiving the cable. The cable is coupled at the forward end to the compression element and extends rearwardly through the channel. A heel holding element is coupled to the rearward end of the cable for attaching to the heel of the ski boot so that the cable and heel holding element "block" the ski boot from exiting the toe plate.

32 Claims, 5 Drawing Sheets

CROSS-COUNTRY SKI BINDING

BACKGROUND OF THE INVENTION

1. The Field of the Invention

The invention herein pertains generally to ski bindings, and more particularly, to cross-country ski bindings.

2. The Background Art

There are basically two popular methods of skiing, downhill and cross-country (or touring). Downhill skiing typically takes place on mountain slopes and involves attaching a ski boot to a ski to hold the skier's foot at a fixed angle, while allowing very little ankle movement. Cross-country skiing, on the other hand, takes place on all varieties of terrain, and involves attaching a ski boot to a ski to allow raising and lowering the ski boot heel, while holding the toe fairly rigidly.

Cross-country skiing, other than when sliding downhill under the force of gravity, is typically accomplished by strides, where the skier slides or glides one foot forward and then the other, repetitively, requiring that the heel of the ski boot be free to pivot upwardly. As a consequence, the cross-country ski binding typically includes a toe plate attached to the ski for holding the toe of the ski boot, and flexible cables extending from the toe plate, along the sides of the ski boot to a heel-holding element for holding the heel of the ski boot. The cables oftentimes are attached to the toe plate by springs to allow a rearward flexing or movement of the cables and to also allow the heel-holding element and the heel of the ski boot to pivot upwardly as desired.

The ski binding configuration described above has several disadvantages including exposure of the cable and "extension" springs so that they are subject to wear, damage, cutting by ski edges, and becoming "iced" and therefore not functional. Also, use of springs which are repeatedly subject to extension generally gives rise to stretching and failure in the resiliency of the springs after time. Further, the use of two, fairly sturdy springs with the cable makes it difficult to reduce the weight of the ski binding, an important consideration in cross-country skiing. Finally, when a ski boot is pivoted forwardly too far, there is a chance the boot will slip out of the toe plate.

OBJECTS AND SUMMARY OF THE INVENTION

It is an object of the present invention to provide a cross-country ski binding that is lightweight and yet rugged and reliable.

It is another object of the invention to provide a cross-country ski binding which is less subject to wear, damage, cutting or icing.

It is a further object of the invention to provide a cross-country ski binding which is durable and long-lived.

It is an additional object of the invention to provide a cross-country ski binding which is compact and simple in design.

The above objects and others not specifically recited are realized in a specific illustrative embodiment of a cross-country ski binding for mounting on a ski to hold a ski boot. The ski binding includes a base plate for mounting on the upper surface of the ski, the base plate having a front section on which a resilient compression element is mounted. The resilient compression element is coupled to a forward end of a cable so that when rearward force is applied to the cable, the compression element provides resistance to the rearward movement of the cable while being compressed, and then expands to pull the cable forward when the force is removed.

Either the base plate is formed with ski boot retaining side walls, or a separate toe plate may be employed. In the latter case, a toe plate is mounted on the base plate for receiving and holding a ski boot toe. The toe plate has a channel formed below the upper surface thereof to extend from the front section rearwardly for receiving the cable. In this manner, the cable passes beneath the skier's boot and so is out of the way and less subject to wear, damage, cutting and icing.

A heel holding element is coupled to the rearward end of the cable for attaching to the heel of the ski boot to assist in holding the ski boot in place in the ski binding, i.e., prevent it from exiting the toe plate.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION

Figure 1:
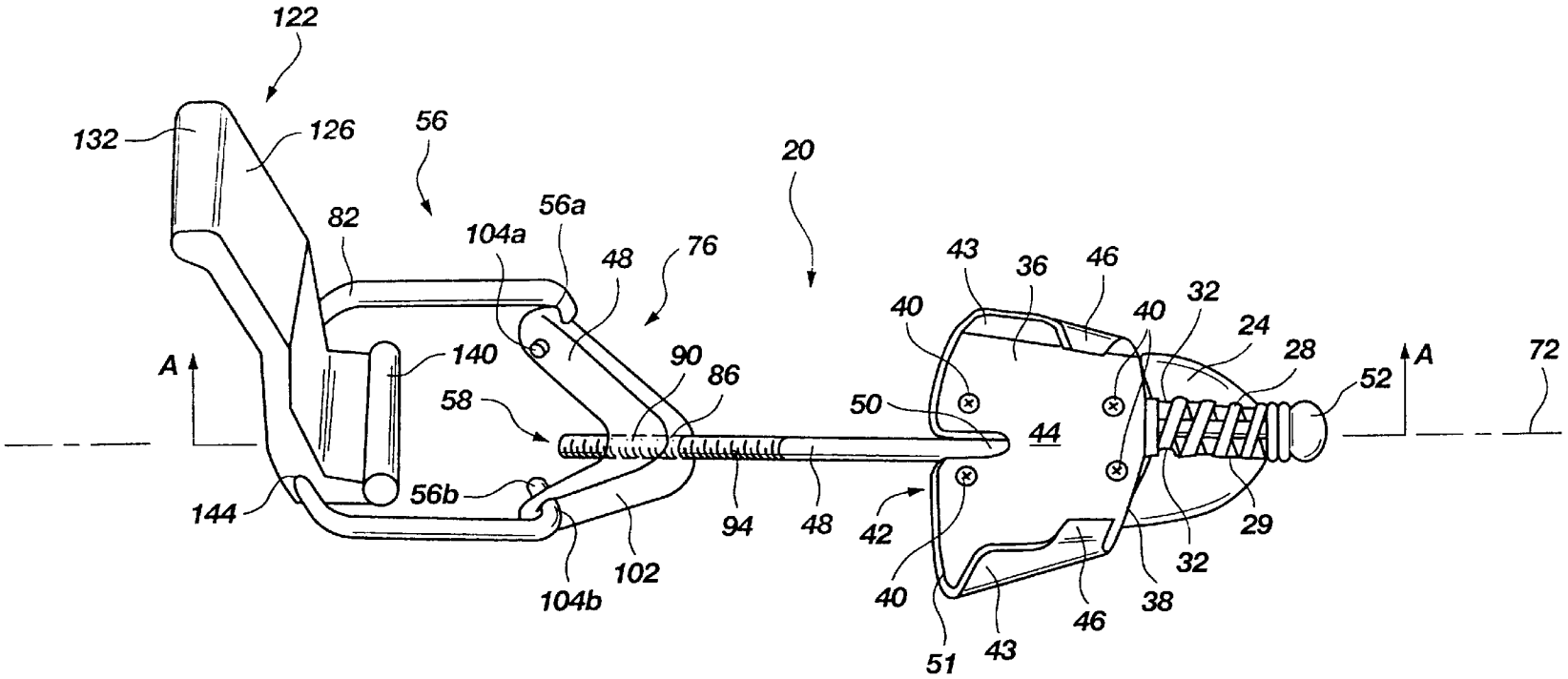
FIG. 1 is a top, perspective view of a cross-country ski binding made in accordance with the principles of the present invention.
Figure 6:
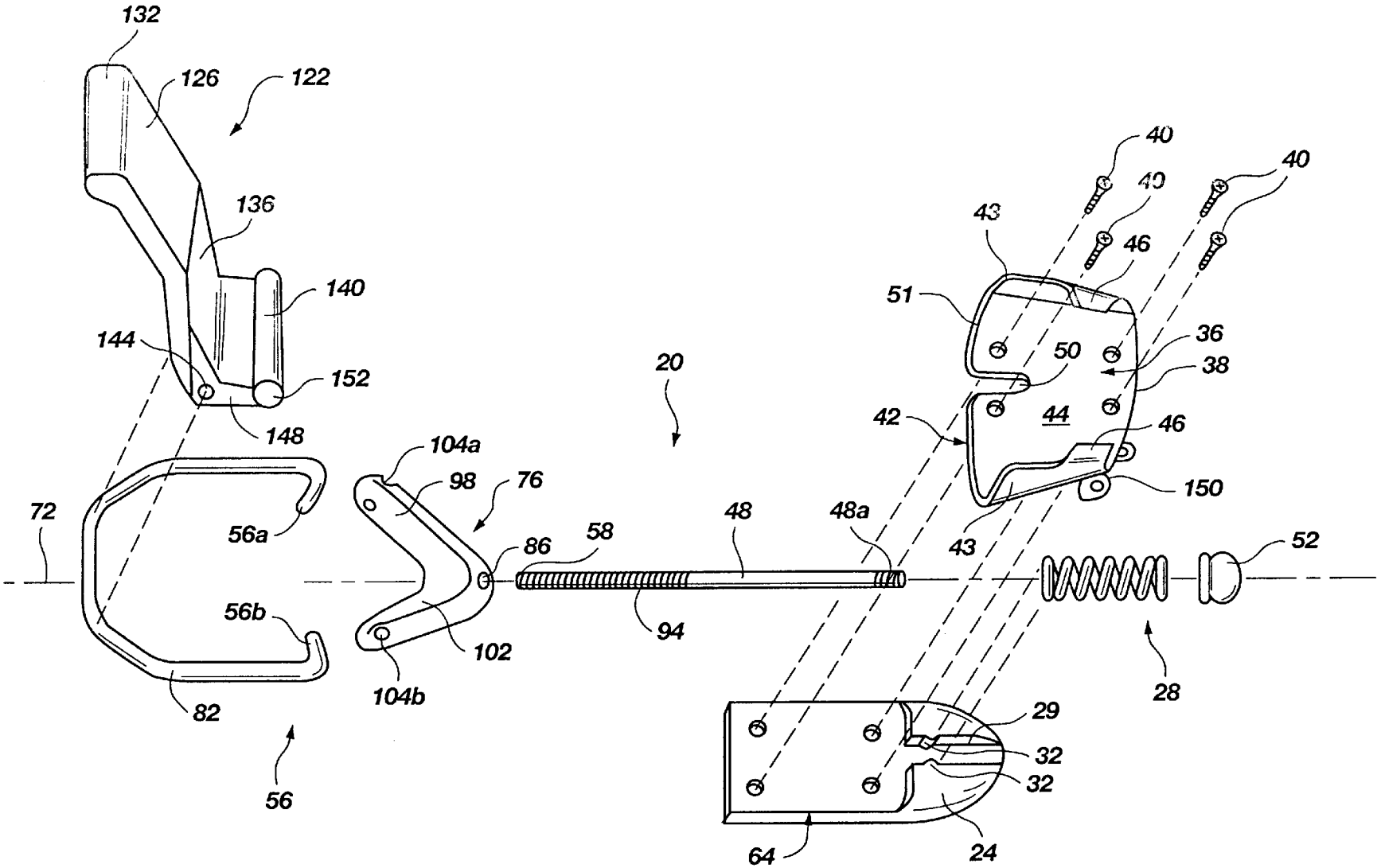
FIG. 6 is an exploded top, perspective view of the embodiment of FIG. 1.

A preferred embodiment in accordance with the present invention is illustrated in FIG. 1, which is a top, perspective view of a cross-country ski binding, generally indicated at 20. Additionally, FIG. 6 is an exploded perspective view of the same embodiment, and carrying the same reference numbers. Referring now to FIGS. 1 and 6, the binding 20 includes a base plate (shown in FIG. 6 at 64), having a front, raised section 24. A resilient coil spring 28 is mounted on the front section 24 in a channel 29 formed in the front section. It is to be understood that a variety of mechanisms could be used in addition to coil springs, including resilient cylinders, bar springs, resilient sleeves, shock absorber cylinders, pneumatic cylinders, and the like, to provide a compressive, resilient force.

Figure 2:
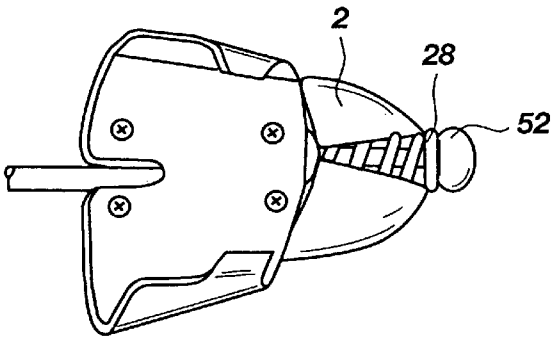
FIG. 2 is a top, perspective view of an alternative embodiment of a cross-country ski binding made in accordance with the present invention.

Opposing nubs 32 are formed in the front section 24 to project partway into the channel 29 and between coils of the spring 28 to prevent the spring from falling out of the channel by acting as female threads into which the coil spring may be screwed. While nubs 32 are used in the embodiment of FIG. 1, it is apparent that other structure could be used to hold the spring 28 in place, such as forming the front section with a partial roof 25 projecting over the spring (FIG. 2).

Referring again to FIGS. 1 and 6, a toe plate 36 is mounted on the base plate 64 (and onto a ski) by four screws 40 (albeit any mounting means such as rivets, welds, adhesives, pins, clamps, or crimps may be used). The toe plate 36 includes a generally planar section 42 with upstanding sides 43 and flanges 46 which extend inward from the tops of the sides to secure the toe of a ski boot. A cable 48 is disposed to extend underneath the toe plate 36, from the front thereof rearwardly, emerging through a notch 50 formed in the back portion of the toe plate 36. The upper surface 44 of the toe plate 36 is substantially smooth, which reduces "icing". The cable 48 advantageously is made of braided or twisted steel wire or similar strong fiber.

The cable 48 is coupled at its forward end, through the coil spring 28, to a ball swedge 52 which prevents the cable from being pulled rearwardly back through the spring, but rather pushes against the spring to compress it when a rearward force is applied to the cable. Alternatively, the forward end of the cable 48 could be threaded, as could the ball 52, to allow the ball to be screwed thereon, and the tension applied to the spring 28 by the cable could be varied by screwing the ball farther on, or farther off the cable.

When a rearward force is applied to the cable 48, the ball 52 is urged rearwardly, causing the spring 28 to be compressed between the ball and the front edge of the toe plate 36, thus presenting a resistance to the rearward movement of the cable 48. When the force is removed from the cable 48, the spring 28 resiliently extends, pulling the cable 48 forwardly.

A heel holding mechanism, generally indicated at 56, is coupled to the rearward end of the cable 48, generally indicated at 58, to assist in holding a ski boot in place in the binding. The heel holding mechanism 56 is coupled to the rearward end 58 of the cable 48 such that its distance from the front of the binding may be selectively varied. In the embodiment shown in FIGS. 1 and 6, this is accomplished by providing the heel holding mechanism 56 with a yoke 76, and a heel wire 82, with the yoke including a threaded bore 86 to allow for screwing the yoke onto a correspondingly threaded end 58 of the cable 48. Of course, the position of the yoke 76 on the cable 48 is varied by simply rotating the yoke on the cable threads. The yoke 76 might advantageously be made of a hot forged aluminum or plastic with metal attachment inserts. The heel wire 82 might be made of a chrome-molybdenum alloy. The heel wire 82 is formed so that it generally conforms to the shape of a ski boot heel (not shown), i.e., generally in a U-shape, with the ends 56*a* and 56*b* being turned inwardly to fit into corresponding openings 104*a* and 104*b* respectively, to secure the heel wire to the yoke (but so that it can pivot upwardly or downwardly).

Figure 3:
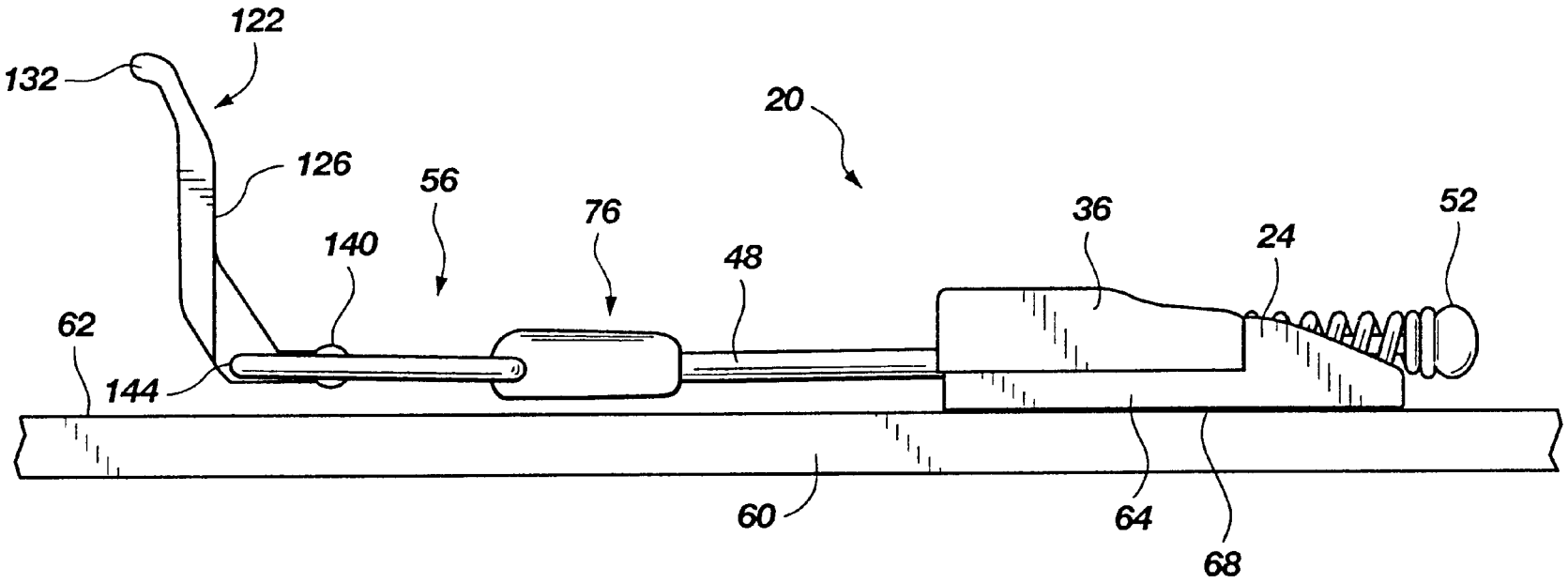
FIG. 3 is a side, elevational view of the embodiment of FIG. 1.
Figure 4:
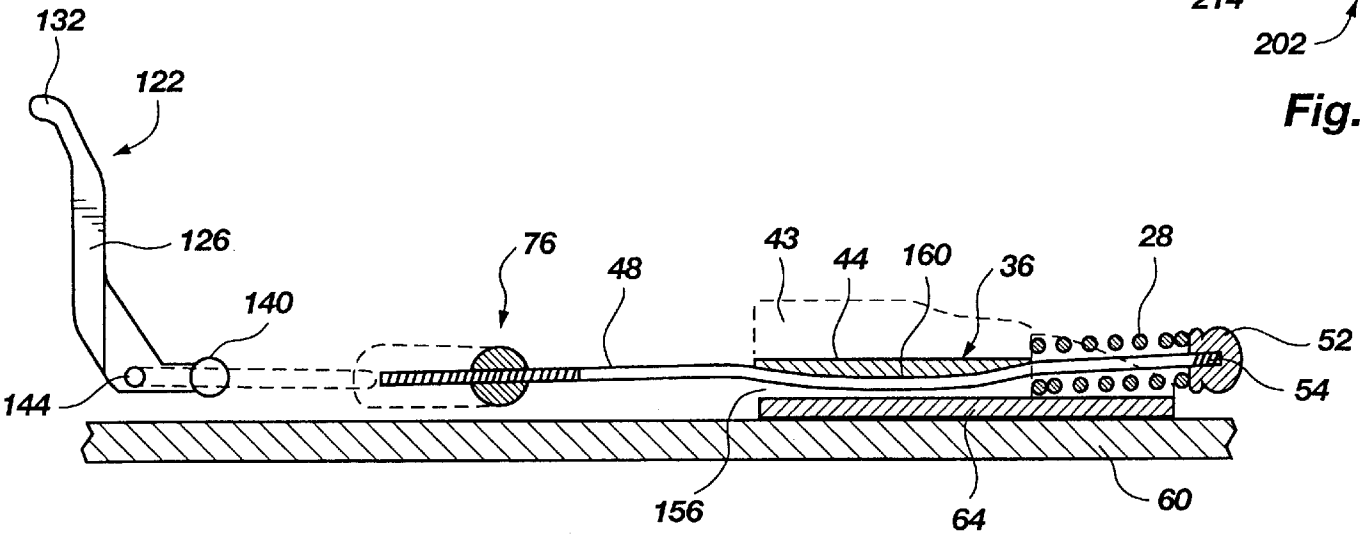
FIG. 4 is a side, cross-sectional view of the embodiment of FIG. 1 taken along section lines A—A.

FIGS. 3 and 4 show respectively a side elevational view of the ski binding of the present invention and a side, cross-sectional view of the ski binding. Both views show the ski binding with the parts assembled, as it would appear on a ski 60. This assembly includes a heel throw/latch 122 of conventional design. The heel throw/latch 122 is pivotally mounted on the rear portion of the heel wire 82 as shown in FIGS. 1, 3 and 4. The heel throw/latch 122 includes a lever arm 126 with a gripping flange 132 extending rearwardly therefrom, and a heel contact flange 140 which fits in the groove at the rear of the heel of ski boots, again in a conventional fashion. The heel wire 82 extends through a bore or channel 144 formed in the heel throw/latch 122. The heel/throw latch 122 might illustratively be made of injectable plastic, aluminum, etc.

FIG. 4 shows the pathway of the cable 48 as it extends from the ball 52 through the coil spring 28 and through a channel 156 formed on the underside of the toe plate 36, to the yoke 76. Note that the channel ceiling wall 160 is formed to be longitudinally convex. This causes less fatigue and failure in the cable 48 extending in contact with ceiling wall.

Alternatively, at least a portion of the channel for carrying the cable 48 from the spring 28 through the base plate 64/toe plate 36 combination could be formed in the base plate, as well as the toe plate.

Figure 5:
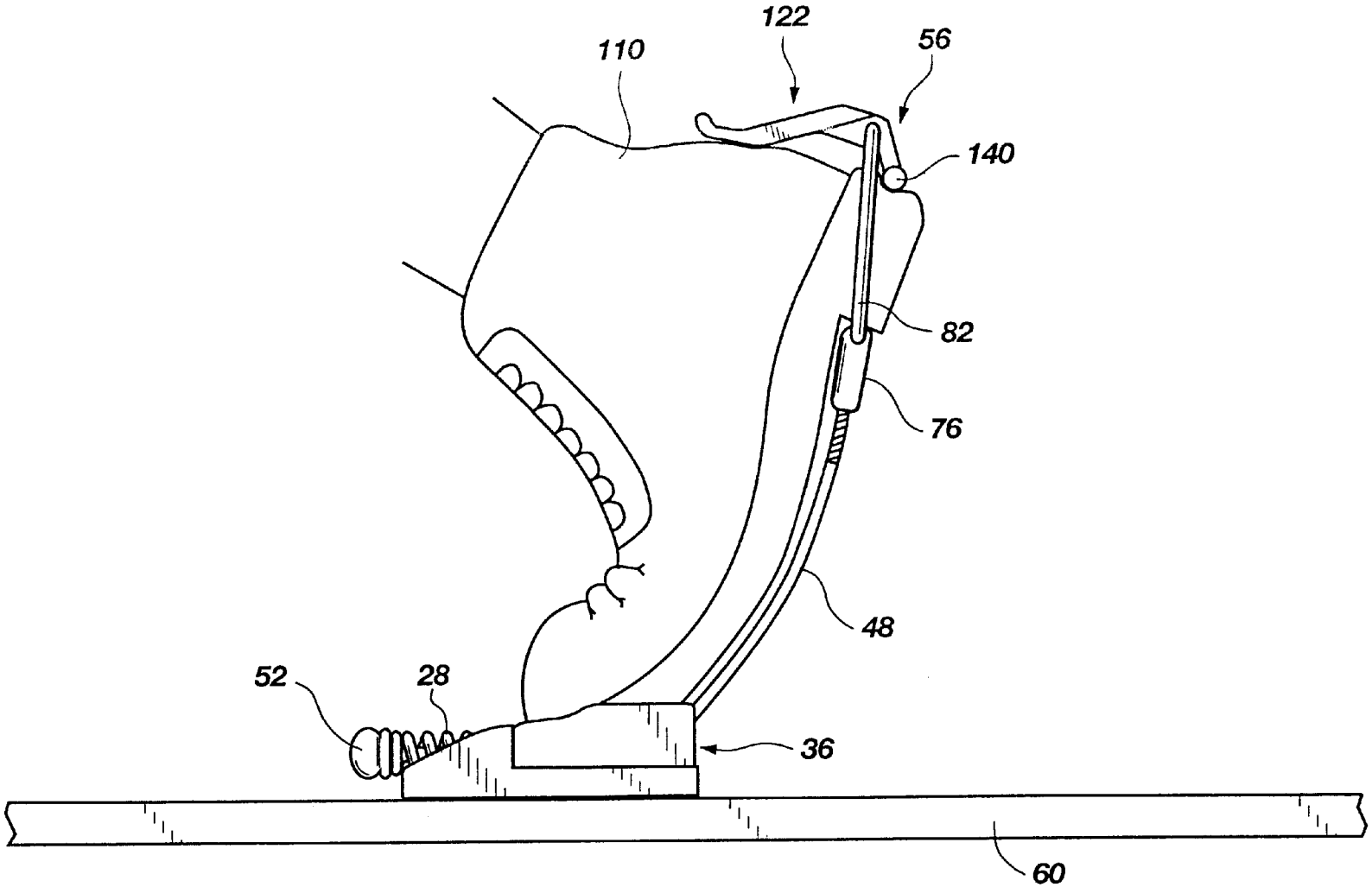
FIG. 5 is a side, elevational view showing the ski binding of the present invention with a ski boot mounted therein.

FIG. 5 shows a ski boot 110 mounted in the ski binding of the present invention and pivoted forwardly with the heel raised from the ski 60, as would be the case if the skier were pushing off while striding on the skis. In this position, the cable 48 flexes upwardly underneath the ski boot 110 and also applies a compressive force to the coil spring 28. Note that the heel wire 82 extends from the yoke 76 about the sides of the boot heel to the heel throw/latch 122, with the heel support flange 140 positioned in the rear groove of the heel of the boot. The resistance to the compressive force applied to the spring 28 places a tension on the cable 48 which helps to hold the boot 110 and in particular the toe of the boot in place in the toe plate 36. As the heel is returned to a rest position on the ski 60, the spring 28 flexes outwardly to pull the cable 48 forwardly again, thereby maintaining some tension on the cable and maintaining the heel of the boot 110 locked or held in position by the heel holding mechanism 56.

Figure 7:
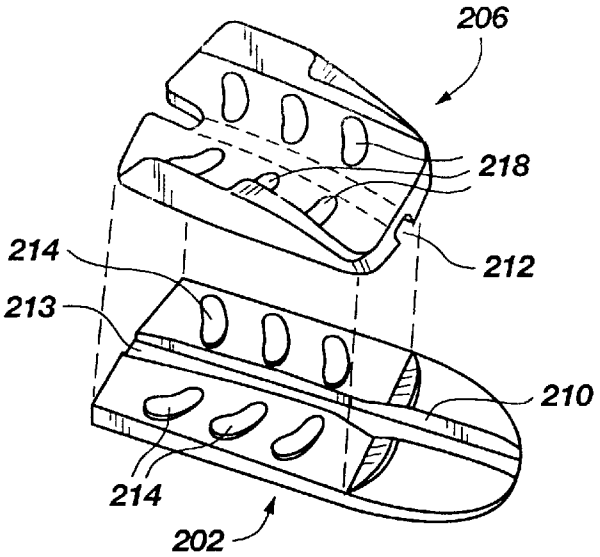
FIG. 7 is an exploded perspective view of an alternative embodiment of the base plate and toe plate of the invention of FIG. 1.

FIG. 7 shows an exploded, perspective view of another embodiment of a base plate 202 and a toe plate 206. The base plate 202 includes a similar channel 210 into which the coil spring would be disposed. Also, a channel 212 formed in the toe plate 206, carries the cable 48 rearwardly. On the upper surface of the base plate 202 are formed upstanding protuberances 214 which are formed to fit snugly within corresponding openings 218 formed in the toe plate 206 when the toe plate is placed on the upper surface of the base plate. In other words, the protuberances 214 fit or register in the openings 218 to restrain lateral, forward or rearward movement of the toe plate relative to the base plate, with the height of the protuberances 214 being substantially the same as the thickness of the toe plate 206 so that the upper surfaces of the protuberances are flush with the upper surface of the toe plate. This, of course, reduces the likelihood of ice formation on the combination base plate/toe plate. A channel 213 is shown formed in the base plate 202 to illustrate how the channel would appear if it were to be in the base plate.

As briefly mentioned earlier, the pathway of the cable between the base plate and toe plate is designed to be one of gradual convex curvature, rather than sharp bends, so that cable fatigue is minimized. Of course, the particular contour of the channel through which the cable passes could take a variety of forms, with the desired feature being that the channel changed direction gradually. Also, although a base plate and toe plate are shown in the embodiments of the drawings, a single plate could be provided with the required channel formed through the center and with the needed upper sidewalls and inwardly directed flanges to hold the toe or boot in place.

Also, to lighten the binding, the base plate might be made of a lightweight but rigid plastic material whereas the toe plate could be made of a metal such as stainless steel on aluminum alloy. Similarly, as already discussed, the yoke could be constructed of aluminum or similar lightweight but durable metal. The single cable would advantageously be constructed of braided on twisted steel on synthetic material such as arramed fiber, to provide the desired strength along with the desired flexibility. Other durable materials which might be used are stainless steel, aluminum alloys, titanium and titanium alloys.

In the manner described, the cross-country ski binding of the present invention provides a lightweight, sturdy and durable binding in which the central element thereof, the single cable, is positioned to provide increased clearance between skis and avoid exposure to wear, damage, impacts and/or cuts from other skis or bindings, and icing. In fact, the position of the cable underneath the skier's ski boot aids in preventing icing of the bottom of the ski boot since the cable, to a certain extent, rubs on the bottom of the boot to inhibit ice accumulation. In effect, the cable serves as a type of mechanical de-icer. Also, the cable being under the boot inhibits the boot from slipping out of the toe plate when the boot is pivoted upwardly and forwardly. Further, the single compression spring, since it is not subjected to stretching, tends to last longer and avoid losing its resiliency. In addition, confining at least a portion of the cable in the channel under the toe plate serves to confine the cable and prevent it from flopping about when the skis are not in use. As mentioned earlier, the channel contours are gradual to avoid sharp bends in the cable and therefore reduce fatigue to the cable. The upper surface of the toe plate, in both the embodiment of FIGS. 1 and 6 and the embodiment in FIG. 7, is maintained smooth, with no openings, holes, etc. in which ice might otherwise form. This allows for easy insertion of the toe of the boot, the cable being out of the way so as not to interfere with such insertion. The position of the yoke on the rear end of the cable allows for convenient placement of the yoke in front of the heel of the ski boot, to conform to the cut of the heel. The distance of the heel holding portion of the binding from the toe plate may be readily adjusted by simply unscrewing the yoke from or screwing the yoke onto the rear end of the cable. In other words a single adjustment is all that is necessary to vary the length of the binding. Finally, because of the few parts necessary for construction of the binding, and because many of those parts can be made from lightweight materials, the entire binding is much lighter than conventional cross-country bindings.

It is to be understood that the above-described arrangements are only illustrative of the application of the principles of the invention. Numerous modifications and alternative arrangements may be devised by those skilled in the art without departing from the spirit and scope of the present invention and the appended claims are intended to cover such modifications and arrangements.

What is claimed is:

1. A ski binding for mounting on a ski and into which a ski boot may be inserted, said ski binding comprising toe holding means for holding the toe of a ski boot to prevent it from substantially moving forwardly or laterally, said toe holding means having an upper surface on which the ski boot rests, compression means mountable proximate the toe holding means, a cable coupled at a forward end to the compression means to compress the compression means when a rearward force is applied to the cable, said compression means expanding to pull the cable forwardly when the rearward force is removed, said cable extending under at least a portion of the upper surface of the toe holding means, means defining a channel below at least a portion of said upper surface of said toe holding means for receiving at least a portion of said cables therein at least a portion of said cable positioned between said toe holding means and a ski to which said toe holding means is attached, and heel holding means coupled to the rearward end of the cable for holding the heel of the ski boot to prevent it from moving substantially rearwardly while allowing the heel to pivot upwardly.

2. The ski binding as in claim 1 wherein the toe holding means comprises a base plate having upper and lower surfaces for mounting on the upper surface of a ski, said base plate including a front section on which the resilient compression means may be mounted, and a toe plate having an upper and lower surface and mounted on the base plate for receiving and holding a ski boot toe, the heel of the ski boot being disposed rearwardly of the toe plate.

3. The ski binding as in claim 2 wherein said front section of said base plate at least partially encloses said resilient compression means.

4. The ski binding as in claim 2 wherein said front section includes at least one holding nub disposed against the resilient compression means to maintain said resilient compression means in said front section.

5. The ski binding as in claim 2 wherein at least said front section of said base plate comprises a material selected from the group consisting of:

a) plastic, b) resin, c) carbon fiber composite, d) aluminum, e) aluminum alloy, f) stainless steel, g) titanium, and h) titanium alloy.

6. The binding as in claim 1 wherein said means defining a channel has a ceiling wall formed with a gradual longitudinal convex curvature.

7. The ski binding as in claim 1 wherein said means defining a channel is formed in the lower surface of the said toe plate.

8. The ski binding as in claim 2 wherein said means defining a channel is formed in the upper surface of said base plate.

9. The ski binding as in claim 1 wherein said resilient compression means comprises a spring.

10. The ski binding as in claim 9 wherein said spring comprises a coil spring through the center of which said cable extends.

11. The ski binding as in claim 1 further comprising at least one stop means fixedly attached to the forward end of the cable and disposed in engagement against the resilient compression means so as to transfer to the resilient compression means rearward force applied to said cable.

12. The ski binding as in claim 11 wherein said stop means is fixedly attached to said resilient compression means.

13. The ski binding as in claim 11 wherein the forward end of the cable is threaded, and wherein said stop means comprises a threaded hollow for screwing onto the threaded end of the cable to contact said resilient means.

14. The ski binding as in claim 2 wherein said toe plate and base plate have coincident longitudinal axes and said channel is formed substantially along said axes, said cable being disposed to extend in said channel and along said axes.

15. The ski binding as in claim 14 wherein said toe plate further comprises a rear edge, said rear edge having a notch through which said cable emerges from said channel.

16. The ski binding as in claim 1 wherein the upper surface of said toe plate is substantially smooth.

17. The ski binding as in claim 1 wherein said heel holding means includes means for varying the location of coupling of the heel holding means to the cable to thereby vary the distance between the heel holding means and the toe plate.

18. The ski binding as in claim 17 wherein said heel holding means further comprises a heel containment means and a heel yoke, said heel yoke being coupled to said rearward end of said cable and said heel containment means being pivotally coupled to said heel yoke to extend rearwardly of the heel yoke, for contacting and containing the heel of a ski boot.

19. The ski binding as in claim 18 further including a heel throw latch means pivotally coupled to said heel containment means for contacting the heel of a ski boot and pivoting to a lock position to hold the heel in the heel containment means.

20. The ski binding as in claim 18 wherein the yoke includes a threaded bore, and wherein the rearward end of the cable is threaded for screwing into the threaded bore of the yoke to enable varying the distance between the heel holding means and the toe plate.

21. The ski binding as in claim 18 wherein the yoke is formed to fit in front of the heel of the ski boot.

22. A method of attaching a cross-country ski boot to a ski comprising the steps of:

(a) mounting resilient compression means on a front section of a base/toe plate attached to the upper surface of the ski, the base/toe plate being formed to receive the toe of a ski boot;

(b) coupling said resilient compression means to a forward end of a cable so that when force is applied rearwardly to said cable, the compression means provides resistance to rearward movement of the cable and compresses with such movement, and then expands to pull said cable forwardly when the rearward force is removed;

(c) extending at least a portion of said cable through at least one channel below at least a portion of an upper surface of the base/toe plate such that said cable extends from the front of said toe plate rearwardly between said base/toe plate and the ski; and (d) coupling a heel holding means to a rearward end of the cable and attaching said heel holding means to the heel of the ski boot to assist in holding the ski boot in place on the ski.

23. A ski binding for mounting on a ski to hold a ski boot, said ski having an upper surface, said binding comprising:

a toe receiving means having upper and lower surfaces for mounting on the upper surface of the ski for receiving the toe of a ski boot, said toe receiving means including a front section on which a resilient compression means may be mounted;

a laterally flexible cable;

resilient compression means mountable on the front section of the toe receiving means for coupling to a forward end of the cable so that when a rearward force is applied to said cable the compression means provides resistance to rearward movement of the cable and compresses with such movement, and then expands to pull the cable forwardly when the rearward force is removed, said front section comprising at least one holding element disposed against the resilient compression means so as to maintain said resilient compression means in position on the front section;

a channel formed below at least a portion of the upper surface of the toe receiving means and extending from the front thereof rearwardly for receiving and containing the cable, said channel having an upper wall with a lengthwise convex curvature; and a heel holding means for receiving the heel of a ski boot, said heel holding means being attached to a rearward end of the cable.

24. A ski binding for mounting on a ski to hold a ski boot, comprising:

a base plate having upper and lower surfaces for mounting on the upper surface of a ski, said base plate including a front section;

a toe plate having an upper and lower surface mounted on the base plate and adapted to receive and hold a ski boot toe, the heel of the ski boot being disposed rearwardly of the toe plate;

a cable having a forward end coupled to the compression means and extending rearwardly below the upper surface of the toe plate and adapted to extend beneath the ski boot;

a coil spring mounted on the front section of the base plate, the forward end of the cable extending through the center of the coil spring;

a stop means fixed on the forward end of the cable for contacting the spring and compressing it when a rearward force is applied to the cable; and heel holding means coupled to a rearward end of the cable and adapted to receive and hold the heel of a ski boot.

25. A ski binding for mounting on a ski and into which a ski boot may be inserted, comprising:

a toe holding device for holding the toe of a ski boot relative thereto;

a cable having a forward end and a rearward end secured at said forward end proximate said toe holding device, said cable extending past said toe holding device at a position between a bottom surface of a ski boot held by said toe holding device and a top surface of a ski to which said toe holding device is attached and further located generally centrally of the bottom surface of the ski boot;

a heel holding mechanism coupled to the rearward end of said cable for holding the heel of the ski boot to prevent it from moving substantially rearwardly relative to the toe holding device while allowing the heel of the boot to pivot upwardly; and a compression device associated with said cable for maintaining tension in said cable.

26. The ski binding of claim 25, further including a channel defined below at least a portion of said toe holding device for receiving at least a portion of said cable therein.

27. The ski binding of claim 26, wherein said channel is defined by a base plate, said base plate being mounted between said toe holding device and the ski.

28. A ski binding for mounting on a ski and into which a ski boot may be inserted, comprising:

a toe holding device for holding the toe of a ski boot relative thereto;

a sole single elongate cable having a forward end and a rearward end, said single elongate cable secured at said forward end proximate said toe holding device and extending under at least a portion of said toe holding device between a bottom surface of said toe holding device and a top surface of a ski to which said toe holding device is attached;

a heel holding mechanism coupled to the rearward end of said cable for retaining the heel of a ski boot to prevent it from moving substantially rearwardly relative to the toe holding device while allowing the heel of the boot to pivot upwardly.

29. The ski binding of claim 28, further including a compression device associated with said cable for maintaining tension in said cable.

30. The ski binding of claim 28, further including a channel defined below at least a portion of said toe holding device for receiving at least a portion of said cable therein.

31. The ski binding of claim 30, wherein said channel is defined by a base plate, said base plate being mounted between said toe holding device and the ski.

32. The ski binding of claim 31, wherein said base plate is mounted to a ski and said toe holding device is mounted to said base plate.

* * * * *